US006732396B2

(12) United States Patent
Laux et al.

(10) Patent No.: US 6,732,396 B2
(45) Date of Patent: May 11, 2004

(54) SELF-WRINGING RATCHET MOP

(75) Inventors: Christopher J. Laux, Hamilton, OH (US); David Hunt, Cincinnati, OH (US); Robert Roth, Cincinnati, OH (US)

(73) Assignee: O-Cedar Brands, Inc., Springfield, OH (US)

( * ) Notice: Subject to any disclaimer, the term of this patent is extended or adjusted under 35 U.S.C. 154(b) by 102 days.

(21) Appl. No.: 10/140,091

(22) Filed: May 7, 2002

(65) Prior Publication Data

US 2003/0208867 A1 Nov. 13, 2003

(51) Int. Cl.[7] ..... A47L 13/142

(52) U.S. Cl. ..... 15/120.2; 15/120.1; 15/116.1; 15/119.1

(58) Field of Search ..... 15/120.2, 120.1, 15/116.1, 119.1

(56) References Cited

U.S. PATENT DOCUMENTS 135,400 A * 2/1873 Boyden ..... 15/120.2 X
1,514,051 A * 11/1924 Jumonville ..... 15/120.2
1,520,500 A * 12/1924 Jumonville ..... 15/120.2
1,735,280 A * 11/1929 Hertzberg ..... 15/120.2
5,509,163 A * 4/1996 Morad ..... 15/120.2
6,212,728 B1 * 4/2001 Facca et al. ..... 15/120.2
6,427,280 B1 * 8/2002 Specht ..... 15/120.2
6,625,838 B2 * 9/2003 Laux et al. ..... 15/120.2

* cited by examiner

*Primary Examiner*—Deborah Jones
*Assistant Examiner*—Abraham Bahta
(74) *Attorney, Agent, or Firm*—Robert R. Lech; Calfee, Halter & Griswold LLP

(57) ABSTRACT

A self-wringing ratchet mop including an elongated handle, a mop head having mop strands supported on the handle, and a wringing mechanism for wringing the mop strands. The wringing mechanism includes a sleeve attached to the mop strands and supported for longitudinal and rotational movement relative to the handle. The handle includes a first ratchet portion formed by teeth and the sleeve includes a second ratchet portion formed by pawl members for engaging the first ratchet portion to permit the sleeve to rotate in a first direction and prevent rotation in a second, opposite direction. The pawl members are supported on a deformable resilient ring wherein deformation of the ring causes the pawl members to disengage from the first ratchet portion and permit rotation of the sleeve in the second direction.

22 Claims, 9 Drawing Sheets

SELF-WRINGING RATCHET MOP

FIELD OF THE INVENTION

The present invention relates generally to mops and, more particularly, to the field of self-wringing ratchet mops.

BACKGROUND OF THE INVENTION

Self-wringing mops are well known and have been the subject of numerous improvements over the years. These mops generally are used to clean the floor surfaces in households, businesses, institutions, etc. Each mop typically includes a handle for supporting a mop head at one end thereof and a means for removing liquid therefrom.

One known disadvantage of early self-wringing mops was the lack of a mechanism to prevent the mop head from unwinding under the increasing tension during the wringing operation. If the mop handle or sleeve of the mop either accidentally slipped or was released from the user's hands before the mop head was wrung sufficiently dry, tension on the mop head tended to cause movement of the sleeve or mop handle relative to each other thereby returning the mop head to its unwound condition.

Attempts have been made to improve the utility of wringable mops by incorporating a ratchet mechanism to hold the mop head in place as the user increases the tension on the mop head during the wringing operation and to allow the user the ability to release the tension after the mop head has been wrung.

For example, U.S. Pat. No. 5,509,163 to Morad discloses a self-wringing mop comprising an outer tubular sleeve which is movable longitudinally and rotatably over an inner shaft and further includes a one-way spring-and-ratchet mechanism. The spring and ratchet mechanism comprises a spring-biased pawl located on the outer tubular sleeve. The pawl is engageable with longitudinal ribs provided on the inner shaft to permit rotation of the outer sleeve in only one direction to wring the mop head. To allow counter rotation of the outer sleeve, the pawl is urged radially outward against the spring until it is disengaged from the ribs, permitting the outer sleeve to rotate freely about an inner shaft so that the mop head can be returned to its initial position. Notably, the mop in Morad requires the use of costly additional parts, such as a separate spring and pawl.

Accordingly, there is a continuing need to provide an improved means for wringing a mop head that is simple in construction, inexpensive and durable. There is also a continuing need to provide a self-wringing ratchet mop which is capable of efficiently manipulating a mop head during wringing operation to dispense liquid therefrom.

SUMMARY OF THE INVENTION

The present invention provides a self-wringing ratchet mop comprising an elongated handle including first and second ends and defining a longitudinal axis. The handle further includes a first ratchet portion having first and second ends and teeth positioned circumferentially around the longitudinal axis. The first end of the first ratchet portion may comprise an enlarged area extending circumferentially around the first ratchet portion and having a top and bottom surface, and a raised portion situated in close proximity to the bottom surface of the enlarged area.

A sleeve is provided defining opposing first and second ends and comprising a tubular shell having an inner diameter wherein the sleeve is positioned over the handle in sliding engagement between the first end of the first ratchet portion and the second end of the handle. The sleeve further includes at least one aperture, preferably a pair of diametrically opposed apertures, located intermediate the first and second ends of the sleeve. The apertures may be situated in a recessed area extending circumferentially around the sleeve.

The mop further comprises a mop head having a plurality of mop strands defining a mop body wherein the mop body is attached to and extends between the second end of the handle and the second end of the sleeve.

A resilient ring is supported around the sleeve and includes at least one pawl member defining a second ratchet portion for receipt within a corresponding aperture and for engagement with the teeth of the first ratchet portion.

The engagement of the first and second ratchet portions allows rotation of the sleeve relative to the handle in a first direction to wring the mop head, and prevent rotation of the sleeve in a second, opposite direction. The resilient ring then can be deformed by a mop user by pressing disengagement areas on the ring such that the second ratchet portion moves radially outwardly from engagement with the teeth to allow the sleeve to rotate in the second direction to unwring the mop head.

In one embodiment, the resilient ring is supported on the sleeve and held in place by a retaining element. The ring includes a pair of diametrically opposed disengagement areas located in spaced relation, preferably 90 degrees, to a pair of diametrically opposed pawl members received within corresponding apertures in the sleeve. After the sleeve has been positioned over the teeth of the first ratchet portion and ratcheted around to wring the mop strands, application of a force to the disengagement area causes the ring to deform to move the pawl member out of engagement with the teeth to unwring the mop.

In another embodiment, the mop further includes a disengagement mechanism comprising a pair of diametrically opposed levers extending radially outwardly from the sleeve wherein application of a force to the lever causes application of a force to corresponding disengagement areas of the resilient ring causing the ring to deform inwardly to move a pair of diametrically opposed pawl members out of engagement with the teeth.

In yet another embodiment, the ring is retained in a recessed area around the sleeve and includes a pair of diametrically opposed disengagement areas located adjacent to a pair of diametrically opposed pawl members. A disengagement mechanism including a pair of diametrically opposed levers extends radially outwardly from the ring and cooperates with the disengagement areas wherein application of a force to the levers causes application of a force to the corresponding disengagement areas causing the ring to deform outwardly to move the pawl members out of engagement with the teeth to unwring a wrung mop head.

The invention will be further described in conjunction with the appended drawings and following detailed description.

DETAILED DESCRIPTION OF THE PREFERRED EMBODIMENT

FIGS. 1–10 show the present invention which concerns an improvement over a mop of the type disclosed in U.S. Pat. No. 5,509,163 to Morad hereby incorporated by reference, which discloses a spring-and-ratchet mechanism for wringing out mops.

Figure 1:
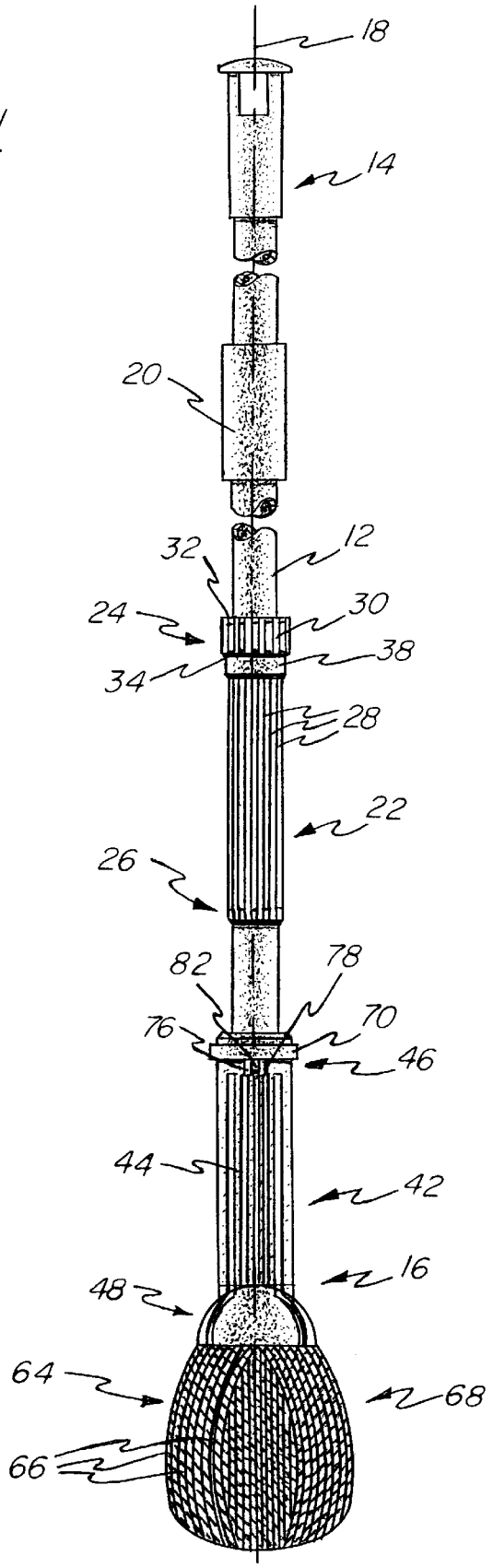
FIG. 1 is an elevational view of a mop of the present invention.

As best shown in FIG. 1, the self-wringing ratchet mop 10 has an elongated handle 12 with first and second ends 14 and 16 and defines a longitudinal axis 18. A padded hand grip 20 may be provided along the handle 12 intermediate the first and second ends 14, 16. The handle 12 further includes a first ratchet portion 22 having first and second ends 24 and 26 and teeth 28 positioned circumferentially around the longitudinal axis 18. The first ratchet portion 22 is located intermediate the first and second ends 14, 16 of the handle 12 and below the hand grip 20.

Figure 3:
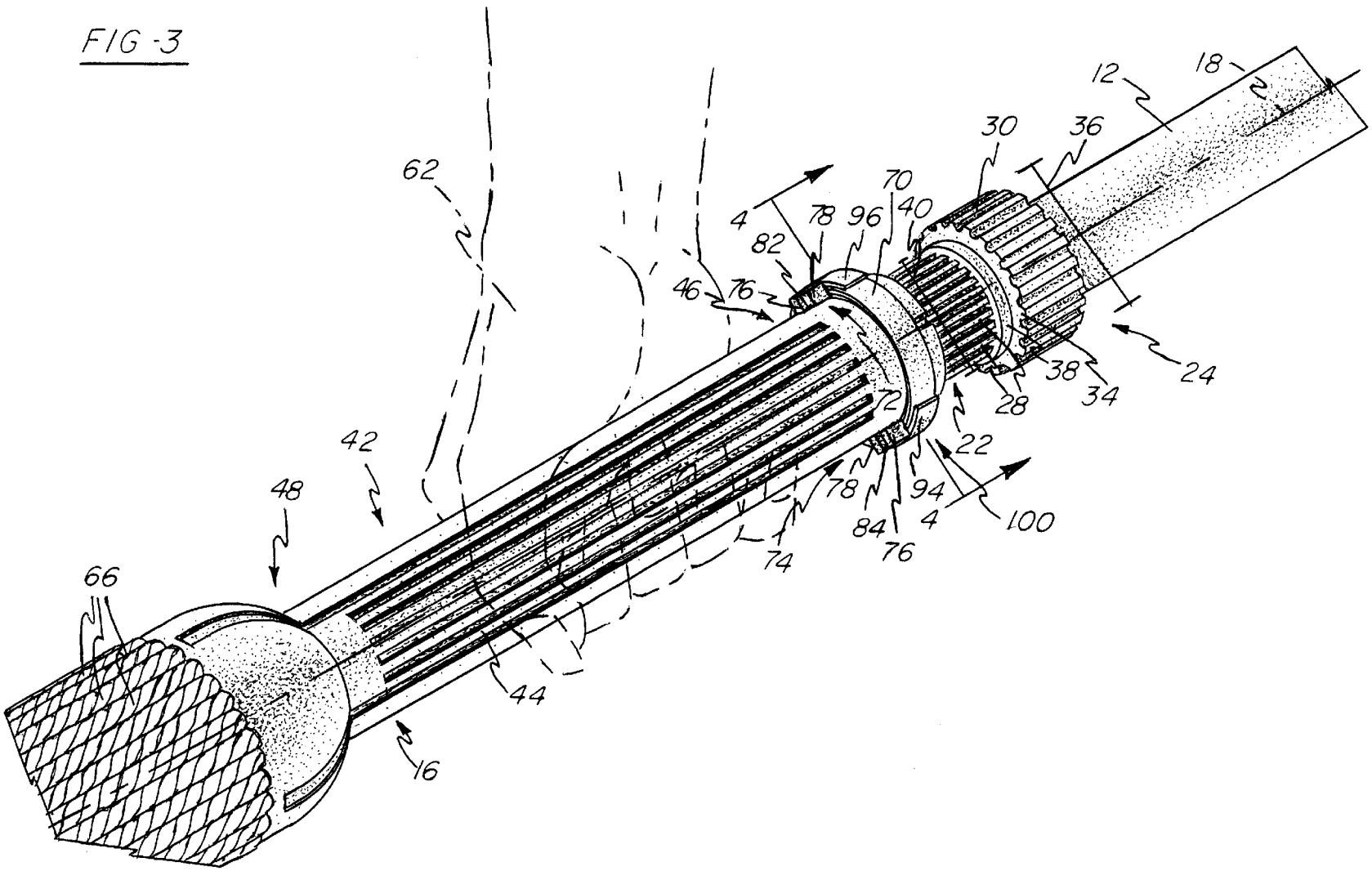
FIG. 3 is a partial perspective view of the mop in FIG. 1.

The first end 24 of the first ratchet portion 22 includes an enlarged area 30 extending circumferentially around the first ratchet portion 22 and having a top and bottom surface 32 and 34 and an outer diameter 36 (FIG. 3) includes a raised portion 38 extending circumferentially around the first ratchet portion 22 and having an outer diameter 40 (FIG. 3). The raised portion 38 is situated in close proximity to the bottom surface 32 of the enlarged area 30.

Figure 2:
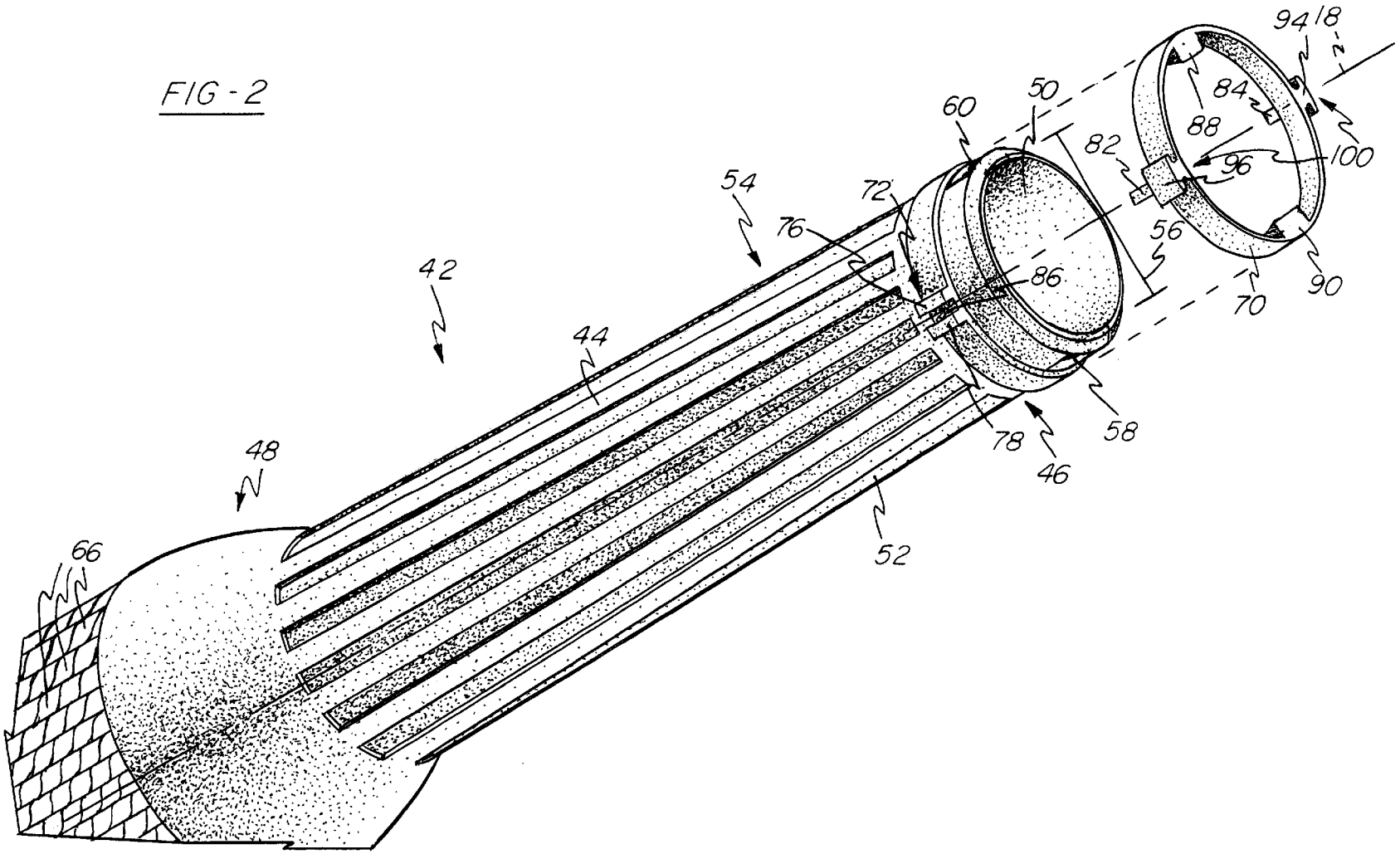
FIG. 2 is an exploded view of the sleeve and resilient ring of the mop in FIG. 1.

Referring further to FIG. 2, the mop 10 includes a sleeve 42 having a grip portion 44 and defining opposing first and second ends 46 and 48 and including inner and outer surfaces 50 and 52 extending circumferentially around the longitudinal axis 18 to form a tubular shell 54. As can be seen in FIG. 1, the sleeve 42 is supported for longitudinal movement along the handle 12 between the first end 24 of the first ratchet portion 22 and the second end 16 of the handle 12. As best seen in FIG. 2, the sleeve 42 has an inner diameter 56 and further includes a pair of diametrically opposed apertures 58 and 60 located intermediate the first and second ends 46, 48 of the sleeve 42. At least a portion of the inner diameter 56 of the sleeve 42 defines a diameter smaller than the outer diameter 40 of the raised portion 38 so that the sleeve 42 can be retained in a friction fit when the first end 46 of the sleeve 42 is positioned over the raised portion 38.

As best seen in FIG. 3, the longitudinal movement of the sleeve 42 is controlled by a mop user 62 (shown in partial), however, longitudinal movement in a direction towards the first end 14 of the handle 12 may be limited by the enlarged area 30 which has an outer diameter 36 larger than the inner diameter 56 (FIG. 2) of the sleeve 42.

As can be seen in FIG. 1, the mop 10 further includes a mop head 64 comprising a plurality of mop strands 66 defining a mop body 68. The mop head 64 may be formed of any strand material known in the art, including strips of absorbent and durable material, such as woven or non-woven natural or synthetic materials, or may consist of a yarn material or any other material capable of providing a strand-like mop body. The mop body 68 extends between the second end 16 of the handle 12 and the second end 48 of the sleeve 42.

As further shown in FIG. 2, a resilient ring 70 is supported on the sleeve 42 over the apertures 58, 60 and is further held from circumferential or rotational movement by a pair of diametrically opposed retaining elements 72 and 74 (FIG. 3). As can be seen in FIG. 3, each retaining element 72, 74 includes a pair of spaced apart parallel flanges 76 and 78 extending outwardly away from the sleeve 42 and aligned with the longitudinal axis 18 while the ring 70 includes a pair of opposed securing flanges 82 and 84 extending downwardly from the ring 70 in a direction towards the second end 16 of the handle 12 such that each securing flange 82, 84 is received within the space 86 (FIG. 2) between the parallel flanges 76, 78 of the retaining elements 72, 74 to restrict rotational movement around the sleeve 42 once assembled thereto. Accordingly, the artisan will appreciate that one or more retaining elements 72, 74 may be used with one or more corresponding securing flanges 82, 84 and that various types of retaining elements may be used which cooperate with the ring 70 for restricting rotational movement of the ring 70 around the sleeve 42.

Figure 4:
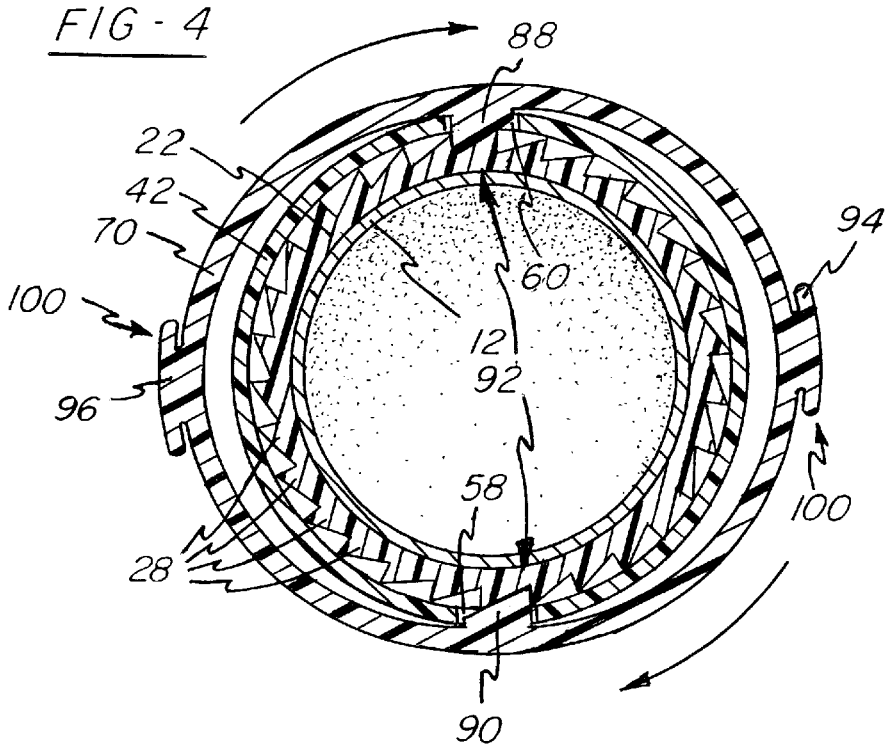
FIG. 4 is a cross-sectional view taken along the line 4—4 of FIG. 3 showing a pair of diametrically opposed disengagement areas located in spaced relation to a pair of diametrically opposed pawl members engaging the teeth of the first ratchet portion.

The resilient ring 70 preferably comprises a resilient, sturdy material such as a plastic and, as shown in FIG. 2, includes a pair of diametrically opposed pawl members 88 and 90 integrally formed therewith to define a second ratchet portion 92 (FIG. 4).

As best seen in FIGS. 3 and 4, the pawl members 88, 90 extend radially inwardly from the ring 70 and through the apertures 58, 60 in the sleeve 42 for engagement with the teeth 28 when the sleeve 42 is located in a longitudinal position over the first ratchet portion 22. Further, the ring 70 has a pair of diametrically opposed disengagement areas 94 and 96 located in spaced relation, preferably 90 degrees relation, to the pawl members 88, 90, in a circumferential direction. The pawl members 88, 90 of the second ratchet portion 92 cooperate with the teeth 28 of the first ratchet portion 22 to define a ratchet mechanism permitting the mop user to rotate the sleeve 42 relative to the handle 12 in a first direction, as indicated by arrows, to wring the mop head 64, and preventing rotation of the sleeve 42 in a second, opposite direction.

Figure 5:
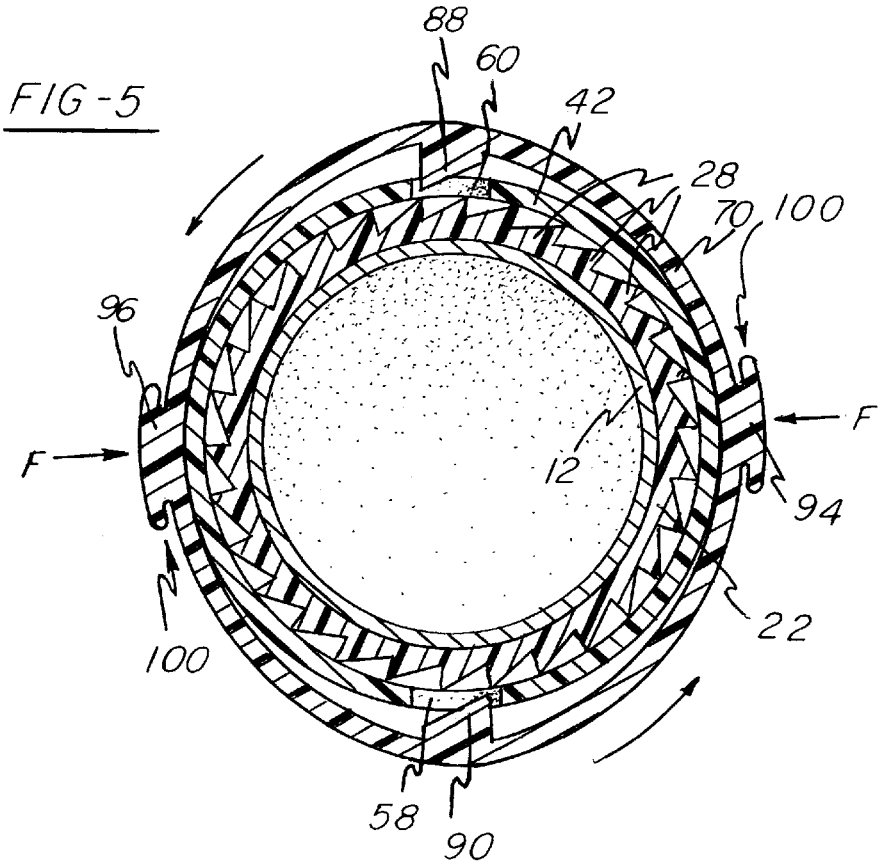
FIG. 5 shows a view similar to FIG. 4 wherein the pawl members have been disengaged outwardly from the teeth of the first ratchet.

After the sleeve 42 has been positioned over the teeth 28 of the first ratchet portion 22 and ratcheted around to wring the mop head 64, FIG. 5 illustrates that application of a force F (by a user) to the disengagement areas 94, 96 deforms the ring 70 inwardly moving the pawl members 88, 90 out of engagement with the teeth 28 allowing the sleeve 42 to rotate in a second direction, indicated by arrows, to unwring the mop head 64. Accordingly, the artisan will appreciate that the ring 70 can be provided with one or more disengagement areas 94, 96 located in spaced relation to one or more corresponding pawl members 88, 90. Further, it should be noted that the hand grip 20 (FIG. 1) on the handle 12 and the grip portion 44 (FIG. 3) on the sleeve 42 provide convenient locations for a mop user (FIG. 3) to grip and rotate the sleeve 42 relative to the handle 12.

Figure 6:
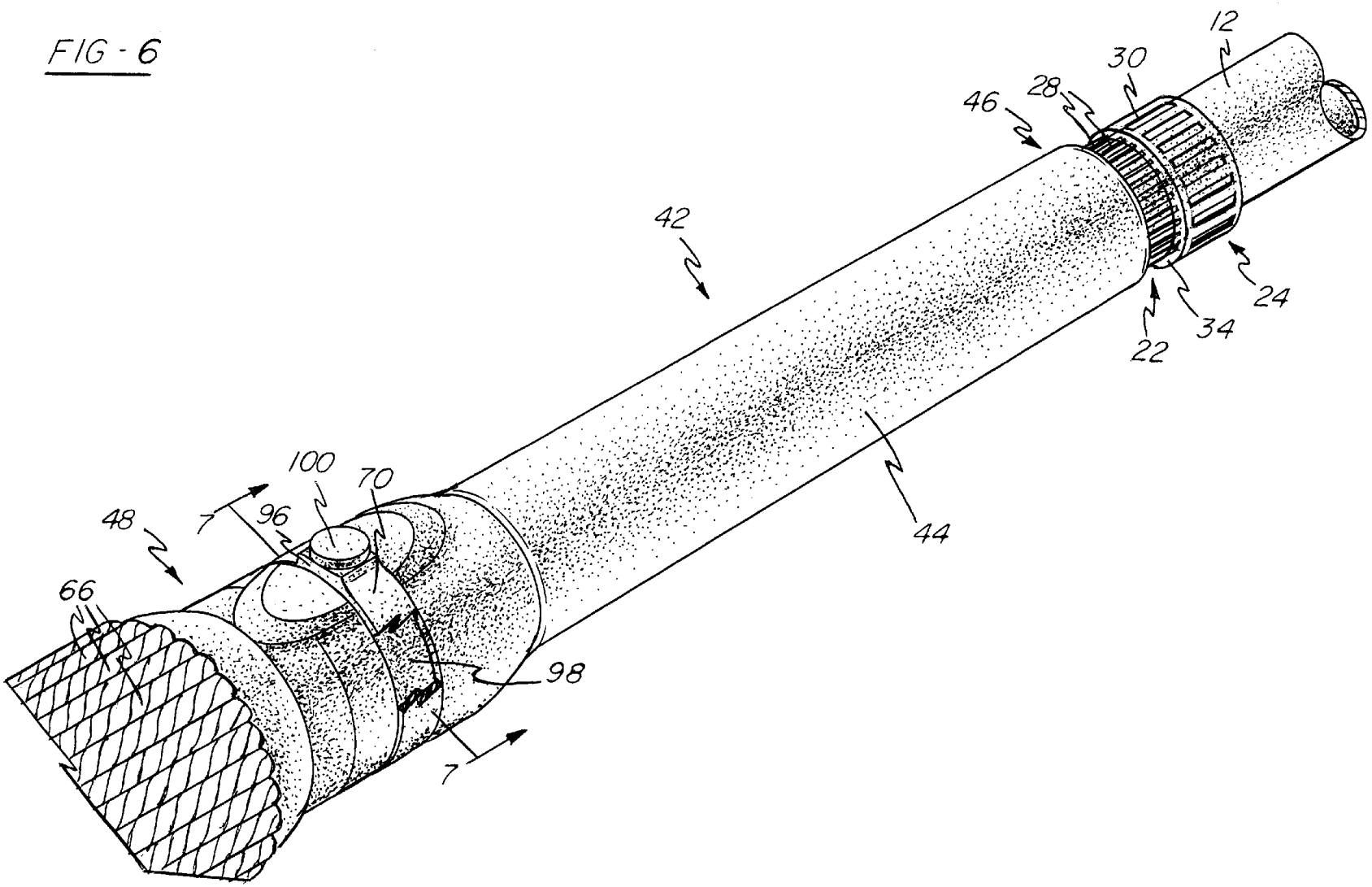
FIG. 6 is a partial perspective view of another embodiment of the mop showing a resilient ring retained in a recessed area around a sleeve positioned over the first ratchet portion.
Figure 7:
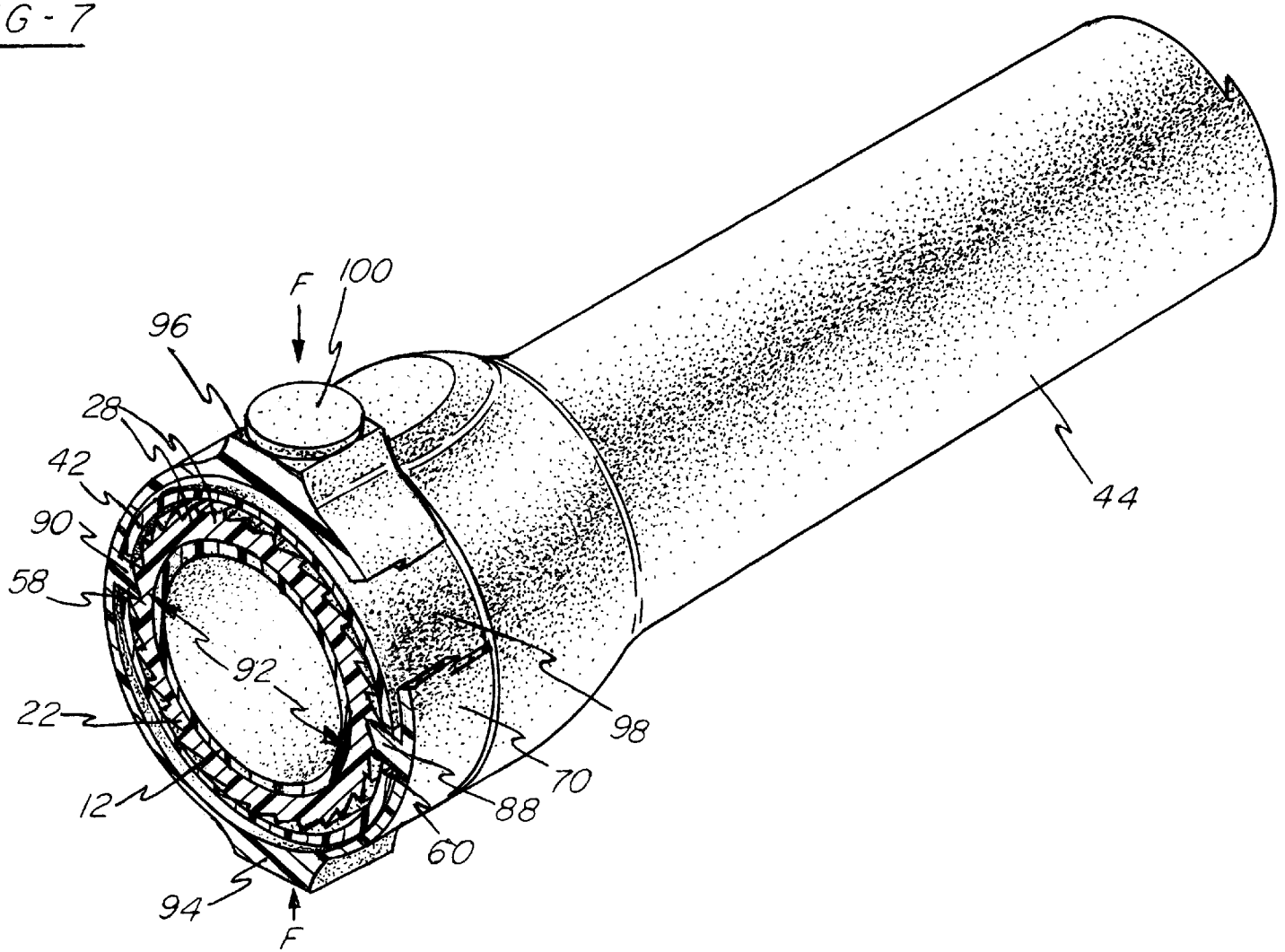
FIG. 7 is a cross-sectional view taken along the line 7—7 of FIG. 6 showing a pair of diametrically opposed disengagement areas located in spaced relation to a pair of diametrically opposed pawl members engaging the teeth of the first ratchet portion.

FIGS. 6 and 7 illustrate an alternate embodiment of the invention in which the ring 70 has a pair of diametrically opposed disengagement areas 94, 96 located in spaced relation, preferably 90 degrees relation, to a pair of diametrically opposed pawl members 88, 90, in a circumferential direction. Each pawl member 88, 90 is received through a corresponding aperture 58, 60 in a recessed area 98 located adjacent the second end 48 of the sleeve. Accordingly, application of a force F to the disengagement areas 94, 96 deforms the ring 70 inwardly moving the pawl members 88, 90 out of engagement with the teeth 28 allowing the sleeve 42 to rotate in a second direction to unwring a wrung mop head 64. The disengagement areas 94, 96 can be indicated by indicia or marker 100 such as a raised area on the ring 70.

Figure 8:
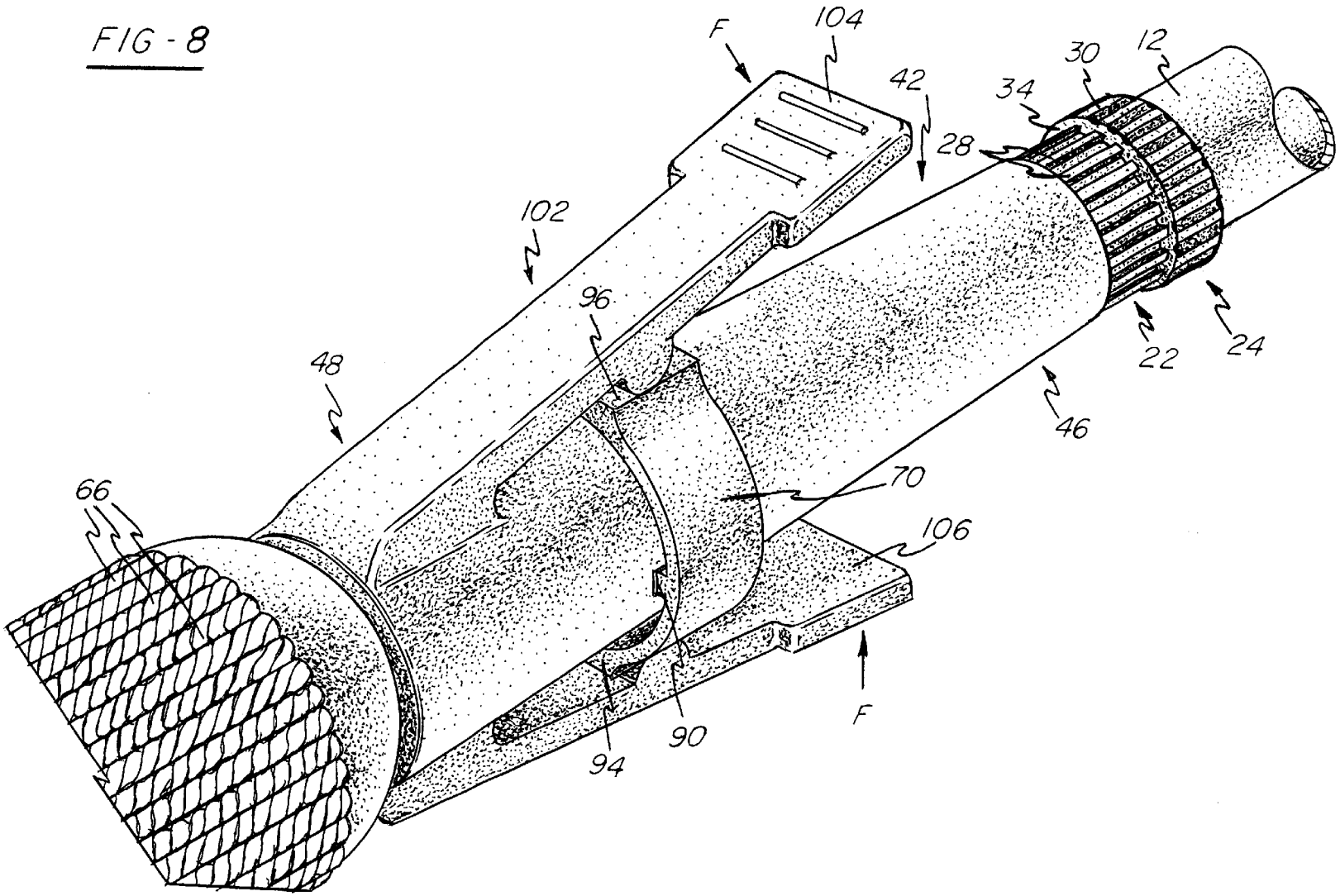
FIG. 8 is a partial perspective view of another embodiment of the mop showing a pair of diametrically opposed levers cooperating with a pair of diametrically opposed disengagement areas.

In another embodiment, as seen in FIG. 8, the mop 10 (FIG. 1) further includes a disengagement mechanism 102 comprising a pair of diametrically opposed levers 104 and 106 extending radially outwardly from the sleeve 42 and cooperating with corresponding disengagement areas 94, 96 located on the ring 70 and in spaced relation, preferably 90 degrees, to a pair of diametrically opposed pawl members 88, 90 (only one shown) received within corresponding apertures 58, 60 (not shown) in the sleeve 42. Similar to FIGS. 4 and 5, after the sleeve 42 is rotated around the first ratchet portion 22 to wring the mop head 64, application of a force to the levers 104, 106 causes application of a force F to the disengagement areas 94, 96 to cause the ring 70 to deform inwardly moving the pawl members 88, 90 out of engagement with the teeth 28 and allowing the sleeve 42 to rotate in a second direction to unwring the mop head 64. Accordingly, the artisan will appreciate that one or more levers 104, 106 can be provided cooperating with one or more disengagement areas 94, 96 located in spaced relation to one or more pawl members 88, 90.

Figure 9:
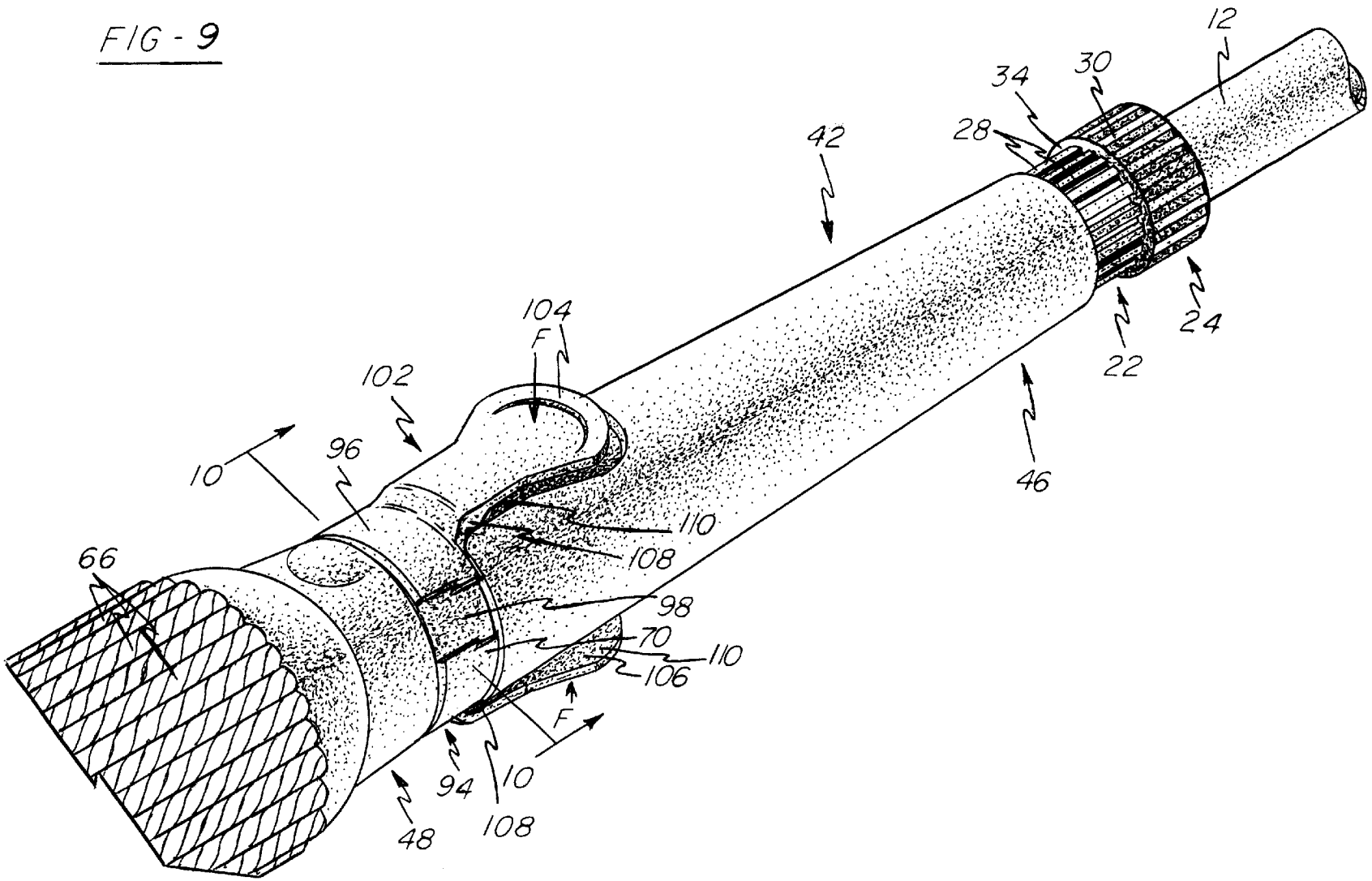
FIG. 9 is a partial perspective view of yet another embodiment of the mop showing a pair of diametrically opposed levers cooperating with a pair of diametrically opposed disengagement areas.
Figure 10:
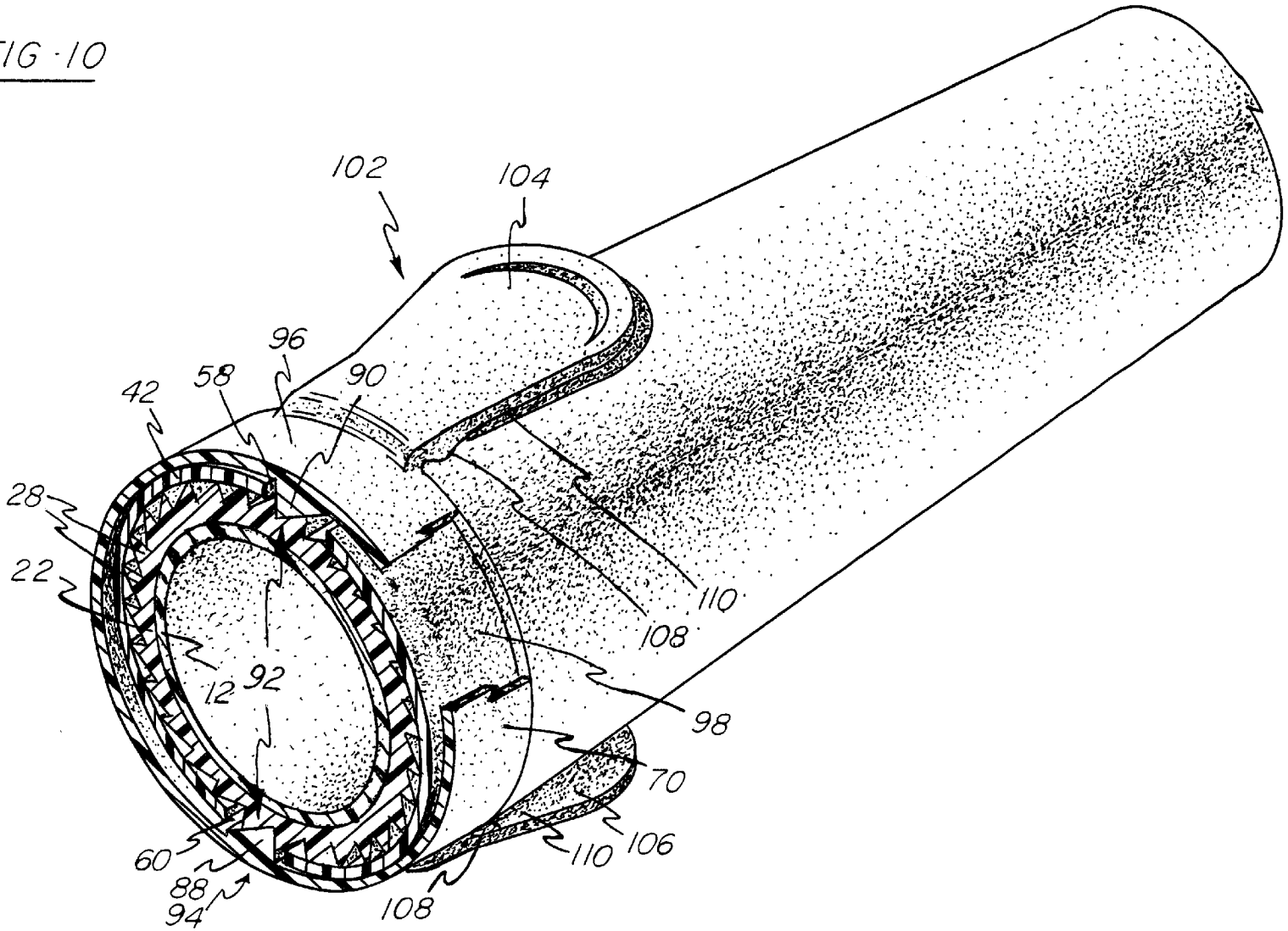
FIG. 10 is a cross-sectional view taken along the line 10—10 of FIG. 9 showing a pair of diametrically opposed levers cooperating with a pair of diametrically opposed disengagement areas located adjacent to a pair of diametrically opposed pawl members engaging the teeth of the first ratchet portion.

In yet another embodiment, FIGS. 9 and 10 show a resilient ring 70 including a pair of diametrically opposed disengagement areas 94, 96 located on the ring 70 adjacent to a pair of opposing pawl members 88, 90, in a circumferential direction. As best seen in FIG. 10, the pawl members 88, 90 are received through corresponding apertures 58, 60 in the sleeve 42. The mop 10 further includes a disengagement mechanism 102 comprising a pair of diametrically opposed levers 104, 106 formed with and extending radially outwardly from the ring 70. Each lever 104, 106 cooperates with a corresponding disengagement area 94, 96 and further includes a fulcrum point 108 extending outwardly from the bottom surface 110 of each lever 104, 106 substantially adjacent the ring 70 and in close relation to the sleeve 42.

After the sleeve 42 is rotated around the first ratchet portion 22 to wring the mop head 64 (FIG. 1), application of force to the levers 104, 106 causes the levers 104, 106 to flex inwardly toward the sleeve 42 so that the fulcrum point 108 presses thereagainst allowing each lever 104, 106 to create application of a force to the disengagement areas 94, 96 to cause the ring 70 to deform outwardly and move the pawl members 88, 90 out of engagement with the teeth 28. Again, the artisan will appreciate that one or more levers 102, 104 can be provided cooperating with one or more disengagement areas 94, 96.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A self-wringing mop comprising:

an elongated handle including first and second ends and defining a longitudinal axis, said handle further comprising a first ratchet portion located intermediate said first and second ends and including teeth positioned circumferentially around said longitudinal axis;

a sleeve comprising a tubular shell positioned in sliding engagement over said handle, said sleeve defining opposing first and second ends;

a mop head comprising a plurality of mop strands defining a mop body, said mop body attached to and extending between said second end of said handle and said second end of said sleeve;

a resilient ring supported on said sleeve, said ring including a pawl member defining a second ratchet portion for engagement with said teeth of said first ratchet portion, said engagement of said first and second ratchet portions allowing rotation of said sleeve relative to said handle in a first direction to wring said mop head, and preventing rotation of said sleeve in a second, opposite direction; and wherein said ring is deformable to move said pawl member radially outwardly from engagement with said teeth whereby said sleeve is allowed to rotate in said second direction.

2. The self-wringing mop of claim 1 wherein said ring is deformable in a radial direction relative to said tubular shell.

3. The self-wringing mop of claim 2 wherein said ring includes a disengagement area located in spaced relation to said pawl member, in a circumferential direction, and application of a force to said disengagement area causes said ring to deform inwardly to move said pawl member out of engagement with said teeth.

4. The self-wringing mop of claim 1 wherein said sleeve includes an aperture and said pawl member extends from said ring through said aperture.

5. The self-wringing mop of claim 1 wherein said ring includes a pair of pawl members located at diametrically opposed locations, and deformation of said ring causes substantially simultaneous movement of said pawl members out of engagement with said teeth.

6. The self-wringing mop as recited in claim 1 wherein said sleeve further comprises at least one retaining element for cooperating with said ring to restrict rotational movement of said ring around said sleeve.

7. The self-wringing mop as recited in claim 1 wherein said first ratchet portion further comprises opposing first and second ends, said first end of said ratchet portion including an enlarged area extending circumferentially around said handle to limit longitudinal movement of said sleeve toward said first end of said handle.

8. The self-wringing mop as recited in claim 1 wherein said sleeve has an inner diameter and wherein said first ratchet portion further comprises opposing first and second ends, said first end of said ratchet portion including a raised portion extending circumferentially therearound and having an outer diameter, said inner diameter of said sleeve being smaller than said outer diameter of said raised portion so that said sleeve can be retained in a friction fit when said first end of said sleeve is positioned over said raised portion.

9. A self-wringing mop comprising:

an elongated handle having first and second ends, and defining a longitudinal axis, said handle further comprising a first ratchet portion located intermediate said first and second ends and extending circumferentially around said longitudinal axis, said first ratchet portion comprising longitudinally extending teeth;

a sleeve including inner and outer surfaces extending circumferentially around said longitudinal axis to form a tubular shell supported for longitudinal movement along said handle, said sleeve including opposing first and second ends and at least one aperture located intermediate said first and second ends of said sleeve;

a mop head comprising a plurality of mop strands defining a mop body, said mop body attached to and extending between said second end of said handle and said second end of said sleeve;

a resilient ring positioned extending around said sleeve and over said at least one aperture, said ring comprising at least one pawl member defining a second ratchet portion, said at least one pawl member extending radially inwardly from said ring through said at least one aperture for engagement with said teeth when said sleeve is located in a longitudinal position over said first ratchet portion, said at least one pawl member of said second ratchet portion cooperating with said teeth of said first ratchet portion to define a ratchet mechanism permitting rotation of said sleeve relative to said handle in a first direction to wring said mop head, and preventing rotation of said sleeve in a second, opposite direction; and wherein said ring is deformable to move said at least one pawl member radially outwardly from engagement with said teeth whereby said sleeve is allowed to rotate in said second direction.

10. The self-wringing mop as recited in claim 9 including a disengagement area located in circumferentially spaced relation to said at least one pawl member wherein an inward force applied to said disengagement area causes said ring to deform to move said at least one pawl member out of engagement with said teeth.

11. The self-wringing mop as recited in claim 10 including a disengagement mechanism comprising at least one lever located in circumferentially spaced relation to said at least one pawl member wherein an inward force on said lever causes said inward force to said disengagement area.

12. The self-wringing mop as recited in claim 10 including a pair of diametrically opposed disengagement areas located in circumferentially spaced relation to said at least one pawl member wherein an inward force applied to said disengagement areas causes said ring to deform to move said at least one pawl member out of engagement with said teeth.

13. The self-wringing mop as recited in claim 12 including a disengagement mechanism comprising a pair of levers supported on said sleeve wherein a force applied to said levers actuates said levers to apply said inward force to said disengagement areas.

14. The self-wringing mop as recited in claim 9 wherein said second ratchet portion comprises a pair of diametrically opposed pawl members located on said ring circumferentially intermediate said pair of disengagement areas.

15. The self-wringing mop as recited in claim 9 including a disengagement mechanism comprising at least one lever located circumferentially adjacent to said at least one pawl member wherein an inward force on said lever causes said ring to deform to move said at least one pawl member out of engagement with said teeth.

16. The self-wringing mop as recited in claim 15 wherein said second ratchet portion comprises a pair of diametrically opposed pawl members located on said ring, and said disengagement mechanism includes a lever circumferentially adjacent each of said disengagement areas wherein an inward force on said levers causes said ring to deform to move said pawl members out of engagement with said teeth.

17. The self-wringing mop as recited in claim 9 wherein said sleeve further comprises at least one retaining element for cooperating with said ring to restrict rotational movement of said ring around said sleeve.

18. The self-wringing mop as recited in claim 9 wherein said first ratchet portion further comprises opposing first and second ends, said first end including an enlarged area extending circumferentially around said handle to limit longitudinal movement of said sleeve toward said first end of said handle.

19. The self-wringing mop as recited in claim 9 wherein said sleeve has an inner diameter and wherein said first ratchet portion further comprises opposing first and second ends, said first end including a raised portion extending circumferentially therearound and having an outer diameter, said inner diameter of said sleeve being smaller than said outer diameter of said raised portion so that said sleeve can be retained in a friction fit when said first end of said sleeve is positioned over said raised portion.

20. A self-wringing mop comprising:

an elongated handle having first and second ends, and defining a longitudinal axis, said handle further comprising a first ratchet portion located intermediate said first and second ends and extending circumferentially around said longitudinal axis, said first ratchet portion comprising longitudinally extending teeth;

a sleeve including inner and outer surfaces extending circumferentially around said longitudinal axis to form a tubular shell supported for longitudinal movement along said handle, said sleeve including opposing first and second ends and a pair of diametrically opposed apertures located intermediate said first and second ends of said sleeve;

a mop head comprising a plurality of mop strands defining a mop body, said mop body attached to and extending between said second end of said handle and said second end of said sleeve;

a resilient ring positioned extending around said sleeve and over said apertures, said ring comprising a pair of diametrically opposed pawl members integrally formed with said ring to define a second ratchet portion, said pawl members extending radially inwardly from said ring through said apertures for engagement with said teeth when said sleeve is located in a longitudinal position over said first ratchet portion, said pawl members of said second ratchet portion cooperating with said teeth of said first ratchet portion to define a ratchet mechanism permitting rotation of said sleeve relative to said handle in a first direction to wring said mop head, and preventing rotation of said sleeve in a second, opposite direction; and a disengagement mechanism comprising levers cooperating with said ring wherein said ring is deformable and an inward force on said levers operates to deform said ring and move said pawl members radially outwardly from engagement with said teeth whereby said sleeve is allowed to rotate in said second direction.

21. The self-wringing mop as recited in claim 20 wherein said levers are located in circumferentially spaced relation to said pawl members.

22. The self-wringing mop as recited in claim 20 wherein said levers are located circumferentially adjacent to said pawl members.

* * * * *